US006727214B1

(12) United States Patent
Church et al.

(10) Patent No.: US 6,727,214 B1
(45) Date of Patent: Apr. 27, 2004

(54) CLEANING METAL SALTS OF INTERMEDIATE LENGTH CARBOXYLIC ACIDS FROM SURFACES

(75) Inventors: Richard J. Church, Berkley, MI (US); Paul A. Kulongowski, Shelby Township, MI (US)

(73) Assignee: Henkel Corporation, Gulph Mills, PA (US)

( * ) Notice: Subject to any disclaimer, the term of this patent is extended or adjusted under 35 U.S.C. 154(b) by 171 days.

(21) Appl. No.: 10/110,493

(22) PCT Filed: Oct. 13, 2000

(86) PCT No.: PCT/US00/28337

§ 371 (c)(1),
(2), (4) Date: Apr. 15, 2002

(87) PCT Pub. No.: WO01/26792

PCT Pub. Date: Apr. 19, 2001

Related U.S. Application Data

(60) Provisional application No. 60/159,328, filed on Oct. 14, 1999.

(51) Int. Cl.[7] ..... C11D 3/04; C11D 3/30; C11D 3/60

(52) U.S. Cl. ..... 510/272; 510/245; 510/504

(58) Field of Search ..... 510/272, 245, 510/504

(56) References Cited

U.S. PATENT DOCUMENTS

| | | | | |
|---|---|---|---|---|
| 3,607,482 | A | 9/1971 | Selm | 156/19 |
| 3,954,648 | A | 5/1976 | Belcak et al. | 252/158 |
| 4,436,643 | A | 3/1984 | Burger et al. | 252/135 |
| 5,250,230 | A | 10/1993 | Steele et al. | 252/544 |
| 5,317,841 | A | 6/1994 | Cook et al. | 51/321 |
| 5,433,885 | A | 7/1995 | Winston et al. | 252/174.24 |
| 5,520,841 | A | 5/1996 | Block et al. | 252/174.23 |
| 5,714,453 | A | 2/1998 | Neumiller | 510/405 |
| 5,834,411 | A | 11/1998 | Bolkan | 510/245 |
| 6,231,678 | B1 | 5/2001 | Arruda et al. | 134/3 |
| 6,425,955 | B1 | 7/2002 | Hacias et al. | 134/2 |
| 6,440,917 | B1 * | 8/2002 | Church et al. | 510/272 |

FOREIGN PATENT DOCUMENTS

| | | |
|---|---|---|
| WO | WO 99/23193 | 5/1999 |
| WO | WO 99/24534 | 5/1999 |
| WO | WO 01/26792 | 4/2001 |

* cited by examiner

*Primary Examiner*—Lorna M. Douyon
*Assistant Examiner*—John M Petruncio
(74) *Attorney, Agent, or Firm*—Stephen D. Harper; Mary K. Cameron

(57) ABSTRACT

A process of cleaning very sparingly water soluble soaps off workpieces after cold forming them is made considerably more economical by using a cleaning solution that causes the removed soap anions to form a separate floating solid phase that can easily be skimmed from the surface of the cleaning solution. When such a separation is made, much longer intervals between replacement of the cleaning solution are possible while still obtaining satisfactory results. A preferred cleaning solution for such a process comprises hydroxides, neutral salts, polymeric quaternary ammonium cations, and a sequestering agent for the counterions of the soap anions to be cleaned.

43 Claims, No Drawings

CLEANING METAL SALTS OF INTERMEDIATE LENGTH CARBOXYLIC ACIDS FROM SURFACES

This application claims priority from International Application No. PCT/US00/28337, filed Oct. 13, 2000 and published in English as WO 01/26792, and from U.S. Provisional Application Ser. No. 60/159,328, filed Oct. 14, 1999.

BACKGROUND OF THE INVENTION

This invention relates to management of a cleaning process that removes metal salts of intermediate length carboxylic acids, i.e., fatty acids with from 10 to 22 carbon atoms per molecule, from surfaces where such salts are present over an underlying water insoluble substrate, particularly a metal substrate. (The remainder of this description will concentrate on metal substrates, but it is to be understood that the description applies, mutatis mutandis, to other types of substrates that are not substantially damaged by contact with, or dissolved in, water.) Between the exposed surface of metal intermediate length carboxylate salt(s) and the substrate surface, there may or may not be other layers such as phosphate conversion coatings, anodized coatings, or complex oxide layers such as those that can be formed with a commercially available product named BONDERITE® 770X from the Henkel Surface Technologies Div. of Henkel Corp., Madison Heights, Mich.

Metal salts, particularly water-insoluble ones, of intermediate length carboxylic acids are widely used as lubricants for cold drawing of steel and other metals, usually over a phosphate or other conversion coating that is believed to act as a "carrier" for the lubricative metal intermediate length carboxylate salt(s). After cold drawing has been completed, in most instances the metal intermediate length carboxylate salt(s) and any underlying conversion coating need to be removed before further processing of the metal article that has been cold drawn.

Such removal/cleaning has been conventionally accomplished with strongly alkaline cleaners, which preferably also contain sequestering agents for the metal cations in any underlying conversion coating, when such a coating is present, and surfactants to aid in wetting of the surface and dispersing and removing soils. However, when substantial amounts of metal intermediate length carboxylate salt(s) have been dissolved, dispersed, or both dissolved and dispersed in such a cleaner, it becomes inadequately effective for further cleaning (and strongly prone to foaming) unless the dissolved, dispersed, or both dissolved and dispersed metal salts of intermediate length carboxylic acids are removed from the used cleaner. Inasmuch as no commercially well established satisfactory method of removing these dissolved, dispersed, or both dissolved and dispersed salts of intermediate length carboxylic acids has appeared in prior art, it is current commercial practice to discard cleaning solutions and replace them with freshly prepared solutions when accumulation of dissolved, dispersed, or both dissolved and dispersed salts of intermediate length carboxylic acids depresses the cleaning ability of the solutions to an unsatisfactory level.

A major object of this invention is to provide a new method for separating dissolved, dispersed, or both dissolved and dispersed salts of intermediate length carboxylic acids from alkaline cleaning solutions containing these salts that will achieve at least one of the following advantages:

allowing satisfactory extended use of the unconsumed ingredients of the cleaning solutions;

avoiding impractical degrees of foaming of used cleaning solutions; and achieving greater overall economy in the cleaning process than the present commercially established alkaline cleaning processes and their associated cleaning solutions.

Other alternative, concurrent, and/or more detailed objects will be apparent from the description below.

Except in the claims and the operating examples, or where otherwise expressly indicated, all numerical quantities in this description indicating amounts of material or conditions of reaction and/or use are to be understood as modified by the word "about" in describing the broadest scope of the invention. Practice within the numerical limits stated is generally preferred, however. Also, throughout the description, unless expressly stated to the contrary: percent, "parts of", and ratio values are by weight or mass; the term "polymer" includes "oligomer", "copolymer", "terpolymer" and the like; the description of a group or class of materials as suitable or preferred for a given purpose in connection with the invention implies that mixtures of any two or more of the members of the group or class are equally suitable or preferred; description of constituents in chemical terms refers to the constituents at the time of addition to any combination specified in the description or of generation in situ within the composition by chemical reaction(s) noted in the specification between one or more newly added constituents and one or more constituents already present in the composition when the other constituents are added, and does not necessarily preclude unspecified chemical interactions among the constituents of a mixture once mixed; specification of constituents in ionic form additionally implies the presence of sufficient counterions to produce electrical neutrality for the composition as a whole and-for any substance added to the composition; any counterions thus implicitly specified preferably are selected from among other constituents explicitly specified in ionic form, to the extent possible; otherwise such counterions may be freely selected, except for avoiding counterions that act adversely to an object of the invention; the word "mole" means "gram mole", and the word itself and all of its grammatical variations may by used for any chemical species defined by all of the types and numbers of atoms present in it, irrespective of whether the species is ionic, neutral, unstable, hypothetical, or in fact a stable neutral substance with well defined molecules; and the terms "solution", "soluble", "homogeneous", and the like are to be understood as including not only true equilibrium solutions or homogeneity but also dispersions that show no visually detectable tendency toward phase separation over a period of observation of at least 100, or preferably at least 1000, hours during which the material is mechanically undisturbed and the temperature of the material is maintained within the range of 18–25° C.

BRIEF SUMMARY OF THE INVENTION

It has been found possible to cause at least the anions of the salts of intermediate length carboxylic acids that are removed by a cleaning solution from a substrate being cleaned to segregate themselves from the bulk of the cleaning solution into a solid phase that floats on the cleaning solution at its temperature of use. The floating solid phase can readily be removed by skimming or some other known technique for separating solid and liquid phases, while the remaining liquid phase can continue to be used for effective cleaning for as long an interval as has been tested, so long as consumed ingredients are replenished in it. The replenishment thus required consumes cleaning materials at a rate that is substantially lower than the overall consumption of fresh cleaning materials by the established processes of discarding cleaning solutions after a relatively small amount of dissolved, dispersed, or both dissolved and dispersed salts of intermediate length carboxylic acids has accumulated in the cleaning solutions. Embodiments of the invention include processes for cleaning and aqueous liquid cleaning compositions particularly useful for this type of cleaning process.

DETAILED DESCRIPTION OF THE INVENTION AND PREFERRED EMBODIMENTS

One composition embodiment of the invention is a homogeneous aqueous liquid cleaning composition that comprises, preferably consists essentially of, or more preferably consists of, water and the following components:

(A) a component of dissolved strongly dissociated cations and anions each with a molecular weight not more than 100 Daltons; and (B) a component of dissolved, dispersed, or both dissolved and dispersed cations with an average molecular weight of at least 200 Daltons; and, optionally, one or more of the following components:

(C) a component of dissolved sequestering agent molecules that are not part of either of immediately previously recited components (A) and (B);

(D) a component of dissolved surfactant molecules that are not part of any of immediately previously recited components (A) through (C); and (E) a component of corrosion inhibitor molecules that are not part of any of immediately previously recited components (A) through (D), said aqueous liquid cleaning composition further having at least 5.0 points of free alkalinity. Points of free alkalinity are determined by titrating a 25 milliliter (hereinafter usually abbreviated as "ml") sample of the composition with 1.0 N strong acid to an end point of pH 8.2, measured with a pH meter or with an indicator such as phenolphthalein; the number of ml of the titrant required equals the points of free alkalinity. The cations and anions of component (A) are "strongly dissociated" for the purposes of this description if the aqueous liquid cleaning composition has an equivalent conductance that is at least 25% of a value calculated from the combined concentrations and equivalent conductances at infinite dilution of its constituent ions of component (A).

A composition according to the invention may be ready for immediate use in cleaning, in which instance it may be designated hereinafter as a "working composition", or it may be a concentrate composition which is suitable for mixture with water and/or, optionally, one or more other concentrate compositions to form a working composition. Of course, some compositions according to the invention are suitable for both of these methods of use.

In order to supply the needed alkalinity of an overall aqueous liquid cleaning composition, component (A) thereof preferably includes hydroxides. Any sufficiently water soluble strongly ionizing hydroxides, including quaternary ammonium hydroxides, may be used, but at least for economy alkali metal, more particularly sodium and/or potassium, hydroxides are preferred. Surprisingly, for maximum storage stability, especially in concentrated form, both sodium and potassium hydroxides are still more preferably included. When the total alkalinity of an aqueous liquid cleaning composition according to the invention is between 9 and 10 points, the molar ratio of potassium hydroxide to sodium hydroxide in the aqueous liquid cleaning composition according to the invention preferably is at least, with increasing preference in the order given, 0.10:1.00, 0.15:1.00, 0.18:1.00, 0.21:1.00, 0.23:1.00, 0.25:1.00, 0.27:1.00, 0.29:1.00, or 0.31:1.00 and independently preferably is not more than, with increasing preference in the order given, 1.00:1.00, 0.90:1.00, 0.80:1.00, 0.70:1.00, 0.60:1.00, 0.50:1.00, 0.45:1.00, 0.42:1.00, 0.39:1.00, 0.37:1.00, 0.35:1.00, or 0.33:1.00. However, any additional hydroxide needed to bring the free alkalinity of an aqueous liquid cleaning composition according to the invention above 10 points preferably is sodium hydroxide only, so that, in an aqueous liquid cleaning composition according to the invention with 21 free alkalinity points, the preferred molar ratio of potassium hydroxide to sodium hydroxide is only 0.02:1.0.

Independently of the chemical nature of the hydroxides, they preferably are present in a concentrate according to the invention at a concentration that is at least, with increasing preference in the order given, 0.4, 0.8, 1.2, 1.6, 1.9, 2.1, or 2.3 moles of hydroxide per kilogram of concentrate (this concentration being hereinafter usually abbreviated as "M/kg" and applied to any constituent of any composition) and independently, at least in a single package concentrate, preferably is not more than, with increasing preference in the order given, 10, 8, 6, 5.5, 5.0, 4.5, 4.0, 3.5, 3.0, 2.8, or 2.6 M/kg. In a working composition for use in a process according to the invention, the total concentration of hydroxides preferably is at least, with increasing preference in the order given, 0.05, 0.10, 0.15, 0.20, 0.25, 0.30, 0.35, 0.38, or 0.40 mole of hydroxide per liter of working composition (the concentration unit of moles of material per liter of a composition containing the material being hereinafter usually abbreviated as "M/l" and freely applied to any constituent of any composition). The optimum concentration of hydroxides has been found to depend on the particular characteristics of the material to be removed, in is a manner that has not been elucidated but that is believed to be connected with variations in the speed with which particular conversion coatings, even those applied under the same nominal conditions, can be dissolved. Highly satisfactory results with an easily removed coating may be achieved even with hydroxide concentrations only slightly above, or even below, the highest preferred minimum specified above. In other instances, however, total hydroxide concentrations of as much as 1.5 M/l may be needed in order to achieve a commercially satisfactory cleaning speed. One of ordinary skill in the art can, with minimal experimentation, readily adjust the concentration of hydroxide in an aqueous liquid cleaning composition according to the invention to suit the particular cleaning performance needed.

The points of free alkalinity of a working composition according to the invention when it is freshly prepared preferably are at least, with increasing preference in the order given, 6.0, 7.0, 7.5, 7.8, 8.1, 8.4, 8.7, or 8.9. Considerably higher values for this concentration appear to be needed for cleaning certain types of soil, in the same manner as already described above for hydroxide. Free alkalinity points values of at least as much as 21 have been determined to be near optimum in some instances. Cleaning is usually uneconomically slow if the value of free alkalinity is too low. If the value is too high, cleaning can also be impaired, although the difference in cleaning efficiency from optimum values normally will be less than if the points of free alkalinity are too low. In addition, however, too high a value of free alkalinity results in loss of economy, inasmuch as more active ingredients are required without obtaining a more satisfactory result.

Although hydroxides are a preferred constituent of component (A) as described above of a composition according to the invention, they preferably are not the only constituent but instead are preferably used together with a subcomponent of neutral salt, preferably a salt that contains monovalent anions. At least for economy, alkali metal halides, particularly sodium chloride, are preferably used. Independent of their exact chemical nature, in an aqueous liquid cleaning composition according to the invention that has a free alkalinity value from 9–10 points, neutral salts preferably are present in a molar ratio to total hydroxides present in the same composition that is at least, with increasing preference in the order given, 0.04:1.00, 0.08:1.00, 0.12:1.00, 0.16:1.00, 0.20:1.00, 0.24:1.00, 0.27:1.00, 0.29:1.00, or 0.31:1.00 and independently, for economy, preferably is not more than, with increasing preference in the order given, 1.00:1.00, 0.90:1.00, 0.80:1.00, 0.70:1.00, 0.60:1.00, 0.55:1.00, 0.50:1.00, 0.45:1.00, 0.40:1.00, 0.37:1.00, or 0.34:1.00. However, if the free alkalinity points of an aqueous liquid cleaning composition according to the invention are 21, then neutral salts are preferably present in a molar ratio to total hydroxide that is at least, with increasing preference in the order given, 0.04:1.00, 0.08:1.00, 0.10:1.00, 0.12:1.00, 0.15:1.00, 0.18:1.00, 0.21:1.00, or 0.24:1.00 and independently, for economy, preferably is not more than, with increasing preference in the order given, 0.50:1.00, 0.40:1.00, 0.30:1.00, 0.25:1.00, or 0.20:1.00. At values of free alkalinity intermediate between 10 and 21, there will be intermediate preferences for the molar ratio of neutral salts to total hydroxide. It should be noted that the upper limit preferences stated above are for economy only, because there has been no observation of any technical deficiency of a process according to the invention even when the ratio of moles of neutral salt to moles of hydroxide was as high as 1.3:1.00

Component (B) as described above of a composition according to the invention preferably comprises nitrogen atoms each of which is bonded to four distinct carbon atoms and carries (at least formally) a positive electronic charge, or in other words quaternary ammonium moieties. More preferably, component (B) comprises cations that contain at least two quaternary ammonium moieties each. Still more preferably, the cations of component (B) are the cations of polymers of molecules that contain at least two moieties each selected from the group consisting of tertiary amino moieties and leaving group moieties such as halogen atoms in organic compounds, which are capable of reacting with one another to form quaternary ammonium cation-containing moieties and anions derived from the leaving groups. The monomers from which these polymers are derived may contain at least one each of tertiary amino moieties and leaving group moieties, in which instance the polymers may be homopolymers, but more often the polymers will be copolymers of one type of molecule that contains at least two tertiary amino moieties and another type of molecule that contains at least two leaving groups. Whether the polymers are homo- or co-polymers, their molecular weight, as measured by intrinsic viscosity, preferably is at least, with increasing preference in the order given, $1\times10^3$, $3\times10^3$, $5\times10^3$, $7\times10^3$, $9\times10^3$, $1.0\times10^4$, $1.5\times10^4$, $2.0\times10^4$, $2.5\times10^4$, or $2.8\times10^4$ and independently preferably is not more than, with increasing preference in the order given, $10^7$, $10^6$, $5\times10^5$, $2\times10^5$, $1.0\times10^5$, $8\times10^4$, $6\times10^4$, $5.0\times10^4$, $4.5\times10^4$, $4.0\times10^4$, or $3.5\times10^4$.

The cations of component (B) that contain quaternary ammonium moieties preferably also contain one or more other nitrogen atoms, with amido nitrogen moieties, especially at least monosubstituted amido nitrogen moieties, being particularly preferred, and cations conforming to one of these preferences preferably constitute at least 70% of the minimum preferred totals for component (B) that are specified below. Independently, the cations of component (B) overall preferably have numbers of nitrogen and of carbon atoms such that the ratio of the number of nitrogen atoms to the number of carbon atoms is at least, with increasing preference in the order given, 0.05:1.00, 0.10:1.00, 0.15:1.00, 0.20:1.00, or 0.25:1.00 and independently preferably is not more than, with increasing preference in the order given, 0.7:1.00, 0.5:1.00, 0.40:1.00, 0.35:1.00, or 0.30:1.00.

The counterions for the cations of component (B) are not believed to be important in determining the effectiveness of the invention, but at least for economy, chloride is preferred.

Independently of its exact chemical characteristics, component (B) preferably constitutes at least, with increasing preference in the order given, 3, 5, 6.0, 7.0, 7.5, 8.0, 8.5, 9.0, 9.5, or 10 parts per thousand by weight (this unit of concentration being hereinafter usually abbreviated as "ppt") of a single package make-up concentrate composition according to the invention and independently preferably constitutes not more than, with increasing preference in the order given, 100, 75, 50, 40, 30, 20, 15, or 13 ppt of a single package make-up concentrate composition according to the invention, these maximum concentration preferences being primarily for economy. In a working composition according to the invention, the concentration of component (B) preferably is at least, with increasing preference in the order given, 0.20, 0.40, 0.50, 0.60, 0.70, 0.80, 0.90, 1.00, 1.10, 1.20, 1.30, 1.35, 1.40, 1.45, 1.50, 1.55, 1.60, 1.65, 1.70, 1.75, or 1.80 ppt and independently preferably is not more than, with increasing preference in the order given, 16, 14, 12, 10, 8.0, 7.0, 6.0, 5.0, 4.5, 4.0, 3.5, 3.0, 2.5, 2.2, or 2.0 ppt, the maximum preferences again being primarily for economy.

Among the optional components, sequestering agent component (C) usually is preferably included, especially when very low solubility salts of intermediate length carboxylic acids, such as the zinc and calcium salts, and/or phosphate conversion coatings are to be cleaned with a particular aqueous liquid cleaning composition according to the invention. Any sufficiently water soluble sequestering agent constituted of molecules each of which contains at least two nucleophilic moieties selected from the group consisting of non-quaternized nitrogen atoms, and keto, aldehydo, carboxyl, carboxylate, and hydroxyl moieties that are not part of carboxyl moieties is suitable. Preferred sequestering agents are selected from those generally known and used in detergent formulations, more specifically ethylene diamine tetraacetic acid and its salts, nitrilotriacetic acid and its salts, citric acid and its salts, malic acid and its salts, tartaric acid and its salts, sugars, and sugar acids and their salts. Sodium glucoheptonate is the single most preferred sequestering agent.

Independently of its exact chemical structure, the concentration of component (C) in a one package concentrate composition according to the invention preferably is at least, with increasing preference in the order given, 0.02, 0.04, 0.06, 0.08, 0.10, or 0.12 M/kg. In a working composition according to the invention, the concentration of component (C) preferably is at least, with increasing preference in the order given, 0.003, 0.006, 0.009, 0.012, 0.014, 0.016, or 0.018 M/l and independently preferably is not more than, with increasing preference in the order given, 0.16, 0.14, 0.12, 0.10, 0.080, 0.060, 0.050, 0.040, 0.035, 0.030, 0.025, or 0.020 M/l. In both instances, the maximum value preferences are primarily for economy, while the minimum value preferences are to assure useful effects from the presence of the sequestering agents. Also, if polymeric sequestering agents are used, each distinct moiety of the polymer molecules that contains at least six carbon atoms and at least two nucleophilic moieties as defined in the preceding paragraph should be considered a separate molecule for the purpose of calculating these concentration preferences.

Component (D) is usually not needed and is therefore usually preferably omitted. However, in some instances, an antifoam agent may be desirable to improve the practicality of the cleaning operation, a hydrotroping agent may be needed to avoid unwanted phase separation, and/or a particularly difficult substrate to wet may need a wetting agent included in the aqueous liquid cleaning composition according to the invention. In any such instance, a suitable surfactant as generally known in the art for the specific purpose needed may advantageously be added.

Component (E) is often advantageously present in an aqueous liquid cleaning composition according to the invention, particularly when cleaning ferrous substrates that are prone to rusting. Numerous corrosion inhibitors are known for this purpose in the art and may be used for component (E), but a material not generally known as a corrosion inhibitor, sodium meta-nitrobenzene sulfonate, has been found to be particularly effective in an aqueous liquid cleaning composition according to this invention and is preferably included if an aqueous liquid cleaning composition without this ingredient produces flash rust on the cleaned substrates. When used, this inhibitor preferably has a concentration in an aqueous liquid cleaning composition according to the invention that is at least, with increasing preference in the order given, 1.0, 1.5, 2.0, 2.5, 3.0, 3.5, 4.0, 4.5, or 4.9 grams of inhibitor per liter of the total aqueous liquid cleaning composition (this unit of concentration being hereinafter applicable to any constituent of the composition and usually abbreviated as "g/l") and independently, at least for economy, preferably is not more than, with increasing preference in the order given, 20, 15, 10, 9.0, 8.0, 7.0, 6.0, or 5.1 g/l.

It has been found that, as intermediate length carboxylic acids and/or their salts are added to an initially highly preferred aqueous liquid cleaning composition according to the invention, both cleaning and flotation effectiveness of the thus used composition substantially deteriorate unless components (A) and (B) and the free alkalinity of the initial composition are replenished. However, although the replenishment materials preferably are the same as for the initially prepared compositions according to the invention, the concentration ratios among the materials preferably are different from those in a make-up concentrate or working composition. Specifically, in a replenisher composition for use in a process according to the invention, the following ratios are independently preferred:

a molar ratio of potassium hydroxide to sodium hydroxide that is at least, with increasing preference in the order given, 0.05:1.00, 0.10:1.00, 0.15:1.00, 0.20:1.00, 0.25:1.00, 0.27:1.00, 0.29:1.00, or 0.31:1.00 and independently is not more than, with increasing preference in the order given, 0.8:1.00, 0.60:1.00, 0.50:1.00, 0.45:1.00, 0.40:1.00, 0.37:1.00, 0.35:1.00, or 0.33:1.00;

a molar ratio of neutral salt to total hydroxide that is at least, with increasing preference in the order given, 1.0:1.00, 1.5:1.00, 2.0:1.00, 2.5:1.00, 3.0:1.00, 3.5:1.00, 3.9:1.00, 4.1:1.00, or 4.3:1.00 and independently is not more than, with increasing preference in the order given, 10:1.00, 9.0:1.00, 8.0:1.00, 7.5:1.00, 7.0:1.00, 6.5:1.00, 6.0:1.00, 5.5:1.00, 5.1:1.00, 4.9:1.00, 4.7:1.00, or 4.5:1.00;

a ratio of grams of component (B) to moles of hydroxide that is at least, with increasing preference in the order given, 6.0:1.00, 10:1.00, 14:1.00, 18:1.00, 22:1.00, 25:1.00, 28:1.00, 30:1.00, 32:1.00, or 34:1.00 and independently, at least for economy, preferably is not more than, with increasing preference in the order given, 150:1.00, 100:1.00, 80:1.00, 70:1.00, 60:1.00, 55:1.00, 50:1.00, 40:1.00, or 36:1.00; and, when component (C) is used, a ratio of moles of component (C) to moles of hydroxide that is at least, with increasing preference in the order given, 0.010:1.00, 0.016:1.00, 0.020:1.00, 0.024:1.00, 0.028:1.00, 0.032:1.00, 0.036:1.00, 0.041:1.00, 0.045:1.00, 0.048:1.00, 0.050:1.00, or 0.052:1.00 and independently, at least for economy, preferably is not more than, with increasing preference in the order given, 0.20:1.00, 0.15:1.00, 0.10:1.00, 0.080:1.00, 0.070:1.00, 0.065:1.00, 0.060:1.00, or 0.055:1.00.

The absolute concentration of a replenisher concentrate is relatively unimportant when it is used, because the amount added can be adjusted to suit the absolute concentration and produce the same additions of active ingredients from concentrates of widely varying concentration. For economy in shipping, the maximum possible concentrations of active ingredients are favored, but there is of course a limit imposed by solubility and/or dispersibility of the active ingredients in water and possible chemical instability and/or unwanted phase separation during storage of a replenisher concentrate. For these reasons, the concentration of neutral salt of component (A) in a replenisher concentrate according to the invention preferably is at least, with increasing preference in the order given, 3, 6, 9, 12, 15, or 18 percent and independently preferably is not more than, with increasing preference in the order given, 33, 31, 29, 27, 25, 23, or 21 percent. Preferred concentrations for other constituents may be derived from these by using the preferred ratios already given above.

A working composition in a process according to the invention is preferably maintained at a temperature that is at least, with increasing preference in the order given, 60, 65, 70, 75, 80, 85, or 90° C. during its contact with substrates to be cleaned. If provision for reflux into the cleaning vessel is used, higher temperatures up to the boiling point of the aqueous liquid cleaning composition can advantageously be used. (If it is worthwhile, as it usually is not, to provide pressurized equipment for cleaning, still higher temperatures can speed the cleaning process.) The needed time of contact will depend on the temperature of the cleaning composition and on the amount and nature of intermediate length carboxylic acids, their salts, and/or other materials to be removed from the particular substrates being cleaned. The time can readily be determined by observation of the extent of removal of the materials desired in a particular instance, with minimal experimentation, by one skilled in the art. As a general guide, for removing a typical multi-layer lubricant coating of metal soap lubricant over zinc phosphate conversion coating as used for heavy cold working, a time not less than five minutes will normally be required and thirty minutes would normally be more than enough, with 10 to 20 minutes perhaps typical, when the aqueous liquid cleaning composition is maintained at 91° C. during cleaning.

At least two different control methods have been found to be effective for maintaining the desired properties of a working composition according to the invention as the working composition is used to clean intermediate length carboxylic acids and/or their salts and optionally other materials such as conversion coatings from substrates. The most direct test of the efficacy of the flotation of dissolved anionic portions of removed intermediate length carboxylic acids and their salts is a Babcock splitting test of the liquid portion of the used cleaning solution. This test may be performed as follows:

To a 150 ml size beaker, add first 10 ml of Reagent Solution 51 and then add 10 ml of the liquid cleaning bath. Mix these liquids thoroughly and heat the mixture to boiling. Filter the boiling hot mixture through a fast filter paper such as Whatman 541 into a Babcock Test Bottle that is graduated from 1 to 8. Wash the beaker and filter paper with another boiling hot 10 ml portion of Reagent Solution 51 and add the washings to the Babcock Test Bottle. (The filter paper may now be discarded.)

Place the Babcock Test Bottle with its contents in a boiling water bath, with the bath at a sufficient level to cover most of the neck of the Babcock Test Bottle, and maintain the open bottle at the temperature of boiling water for at least 30 minutes. Then add 20 ml of Reagent Solution 44 to the Babcock Test Bottle, swirl the bottle to mix the contents, and heat the Babcock Test Bottle and its contents in the boiling water bath until a distinct floating liquid oily phase forms on top of the contents or for 10 minutes, whichever is shorter. If no oily phase forms, record the Babcock Test Value as 0. If an oily phase does form, add boiling hot water to the Babcock Test Bottle if needed until both the top and bottom of the floating liquid phase are within the graduated area of the Babcock Test Bottle neck. The difference between the graduations at the top and bottom of the upper liquid phase is the Babcock Test Value. (Do not remove the Babcock Test Bottle from the boiling water bath before taking the reading that determines the Babcock Test Value, because rapid cooling and consequent shrinkage will lead to an erroneous reading.)

Reagent Solutions 51 and 44 and Babcock Test Bottles are commercially available from Henkel Surface Technologies Division of Henkel Corporation, Madison Heights, Mich.

When a cleaning process according to the invention is operating as desired, the Babcock Number of the cleaning solution will be no more than, with increasing preference in the order given, 0.075, 0.060, 0.050, 0.040, 0.030, 0.020, or 0.010. Whenever a Babcock Test Value greater than this is measured, at least more neutral salt of component (A) and preferably also more component (B) should be added in an amount sufficient to reduce the Babcock Test Value below its target maximum. More preferably, a full replenisher concentrate as described above should be added in sufficient amount to reduce the Babcock Test Value below its target maximum.

It has also been found that the need for replenishment of an aqueous liquid cleaning composition according to the invention can be more conveniently and rapidly determined by testing the free alkalinity of the composition as it is used. By this method of control, the composition is preferably replenished during use whenever its measured alkalinity decreases by as much as, with increasing preference in the order given, 1.0, 0.8, 0.6, 0.50, 0.40, 0.30, 0.20, 0.15, 0.10, or 0.05 points of free alkalinity from the value that the particular aqueous liquid cleaning composition had when freshly prepared. As with the control method using the Babcock Test Value, during early stages of use an aqueous liquid cleaning composition according to the invention can be replenished with neutral salt only or with neutral salt and component (B) only, but eventually replenishment of alkalinity is also required, so that the most preferable replenishment is with a full replenisher concentrate as described above.

Under consistent operating conditions, of course, it may become possible to replenish an aqueous liquid cleaning composition according to the invention by experience alone, without the need for making any measurements to indicate when replenishment is required.

The invention may be appreciated in greater detail from consideration of the following working and comparison examples.

GROUP 1—EXAMPLE WORKING COMPOSITIONS

The amounts of active ingredients in several working compositions that caused the stearate ions of added sodium stearate and/or stearic acid to segregate themselves into a floating solid phase are shown in Table 1. These were tested by adding to the working composition 15 g/l of a product that contains, in water solution: 54% of commercial stearic acid, which may be up to 5% palmitic acid; 7.9% of sodium hydroxide; and 0.5% of pine oil, and observing that a floating solid phase was formed.

EXAMPLE AND COMPARISON EXAMPLE GROUP 2

In this group, the temporary exhaustion of the cleaning power of a working composition according to the invention and its regeneration are demonstrated. In connection with these experiments, steel coupons that had been first zinc phosphate conversion coated and then coated with a solution made by mixing 0.9 moles of sodium hydroxide

TABLE 1

| | Grams per Liter of Ingredient in Working Composition Example Number: | | | | | | | | | | |
|---|---|---|---|---|---|---|---|---|---|---|---|
| Ingredient | 1 | 2 | 3 | 4 | 5 | 6 | 7 | 8 | 9 | 10 | 11 |
| Sodium Hydroxide | 16 | 16 | 11.7 | 11.7 | 11.7 | 11.7 | 11.7 | 11.7 | 11.7 | 11.7 | 11.7 |
| Potassium Hydroxide | none | none | 5.8 | 5.8 | 5.8 | 5.8 | 5.8 | 5.8 | 5.8 | 5.8 | 5.8 |
| Sodium Chloride | none | none | 14.1 | 14.1 | 14.1 | 14.1 | 14.1 | 14.1 | 14.1 | 14.1 | 14.1 |
| MIRAPOL ™ WT | 0.5 | none | none | 3.0 | 3.0 | 3.0 | 2.2 | 2.2 | 2.2 | 2.2 | 2.2 |
| BUSAN ™ 77 | none | 1.0 | none | none | none | none | none | none | none | none | none |
| MIRAPOL ™ 100 | none | none | 1.8* | none | none | none | none | none | none | none | none |
| CHEMQUAT ™ 12/50 | none | none | none | 4.0 | none | none | 0.8 | 1.6 | none | none | none |

TABLE 1-continued

| Ingredient | Grams per Liter of Ingredient in Working Composition Example Number: 1 | 2 | 3 | 4 | 5 | 6 | 7 | 8 | 9 | 10 | 11 |
|---|---|---|---|---|---|---|---|---|---|---|---|
| CHEMQUAT ™ C/33-W | none | none | none | none | 6.0 | none | none | none | 1.1 | none | none |
| CHEMQUAT ™ 508/40 | none | none | none | none | none | 0.45 | none | none | none | none | none |
| VARIQUAT ™ 66 | none | none | none | none | none | none | none | none | none | 3.0 | none |
| VARIQUAT ™ 1215 | none | none | none | none | none | none | none | none | none | none | 3.0 |
| Sorbitol | 4.5 | 4.5 | none | none | none | none | none | none | none | none | none |
| Sodium Glucoheptonate | 2.0 | 2.0 | 4.8 | 4.8 | 4.8 | 4.8 | 4.8 | 4.8 | 4.8 | 4.8 | 4.8 |
| Glycerine | 3.2 | 3.2 | none | none | none | none | none | none | none | none | none |
| Monoethanol Amine | 1.2 | 1.2 | none | none | none | none | none | none | none | none | none |

FOOTNOTE AND OTHER NOTES FOR TABLE 1

*This value is for the reported active ingredients only.

MIRAPOL ™ WT ™ and MIRAPOL ™ 100 are both commercial products of Rhodia Corp. and are reported by their supplier to be respectively (i) an approximately 62% solution in water of a quaternary ammonium copolymer of 1,1-oxybis[2-chloroethane] and N,N'-bis[3-(dimethylamino)propyl] urea, the copolymer having a molecular weight as measured by intrinsic viscosity of about $3 \times 10^4$, and (ii) a solution in water of a homopolymer of diallyl dimethyl ammonium chloride respectively; BUSAN ™ 77 is a commercial product of Buckman Laboratories and is reported by its supplier to contain 60% of a quaternary ammonium copolymer of 1,1-oxybis[2-chloroethane] and N,N,N',N'-tetramethyl-1,2-ethanediamine, the remainder of the composition being proprietary; CHEMQUAT ™ 12/50, CHEMQUAT ™ C/33-W and CHEMQUAT ™ 508/40 are all commercial products of Chemax Corp. and are reported by their supplier to be solutions in water of, respectively: (i) 33% of lauryl triethyl ammonium chloride, (ii) 33% of cocotrimethyl ammonium chloride, and (iii) 40% of (benzylmethyl) octyl dimethyl ammonium chloride; VARIQUAT ™ 66 and VARIQUAT ™ 1215 are commercial products of Witco Corp. and are reported to be solutions in water of, respectively, (i) ethyl bis(polyhydroxyethyl)alkyl ammonium ethyl sulfates and (ii) ethoxylated cocoamines.

in water solution per mole of commercial grade stearic acid were used to test cleaning during 10 minutes contact with the tested aqueous liquid cleaning composition at a temperature of 91° C. The concentration of intermediate length carboxylic acids and their salts in the used aqueous liquid cleaning composition was determined by the Babcock Value as described above.

The working composition prepared when still unused had been made by mixing with water: 3.9 g/l of KOH; 8.5 g/l of NaOH; 10.2 g/l of NaCl; 2.2 g/l of MIRAPOL™ WT; and 3.4 g/l of $NaOOC(CHOH)_5CH_2OH$ (i.e., sodium glucoheptonate). In order to accelerate the testing, without having to clean large surface areas, the solution noted above that was made by mixing sodium hydroxide and stearic acid in water solution was added to simulate dissolution of stearic acid/stearate salts from a large area of surface to be cleaned. This solution contained about 54% stearic acid stoichiometric equivalent. Results are shown in Table 2 below. (The value shown for stearic acid is the stoichiometric equivalent as acid of acid itself plus its anions, the latter of which are expected to predominate in the solution in which these substances were added.) The results in Table 2 show that by the time 8.1 g/l of stearic acid had been added without any replenishment, the process and composition according to the invention described in the first two lines of Table 2 was no longer functioning properly. Full functioning could be restored, however, by the extent of replenishment indicated in the last line of Table 2.

TABLE 2

| Cumulated: Grams per Liter of Additions of: Stearic Acid | NaCl | MIRAPOL ™ WT | Test Results after Additions: Babcock Test | Coating % Removed |
|---|---|---|---|---|
| None | None | None | 0.00 | 95 |
| 2.7 | None | None | <0.05 | 95 |

TABLE 2-continued

| Cumulated: Grams per Liter of Additions of: Stearic Acid | NaCl | MIRAPOL ™ WT | Test Results after Additions: Babcock Test | Coating % Removed |
|---|---|---|---|---|
| 5.4 | None | None | 0.1 | 30 |
| 8.1 | None | None | 0.15 | 10 |
| 8.1 | 10.4 | 2.2 | <0.05 | not measured |
| 8.1 | 10.4 | 4.4 | <0.05 | 95 |

EXAMPLE GROUP 3

In this group, the same procedures and test materials were used as in Group 2 above, except:

Points of free alkalinity were measured instead of Babcock Value; and

A complete replenisher concentrate was used for replenishment instead of separate additions of active ingredients. The replenisher concentrate was made by mixing with water: 11 ppt of KOH; 26 ppt of NaOH; 209 ppt of NaCl; 28 ppt of MIRAPOL™ WT; and 11 ppt of $NaOOC(CHOH)_5CH_2OH$.

The initial working compositions in this group were made by diluting a make-up concentrate that had been made by mixing with water: 32 ppt of KOH; 25.6 ppt of NaOH; 46 ppt of NaCl; 20 ppt of MIRAPOL™ WT; and 31 ppt of $NaOOC(CHOH)_5CH_2OH$.

In the first part of this group, the initial working composition was a solution in water of 10.6% by volume of the make-up concentrate. Results are shown in Table 3.1 below.

TABLE 3.1

| Cumulated Additions, per Liter: | | Points of Free Alkalinity | | |
|---|---|---|---|---|
| Grams of Stearic Acid | ml of Replenisher Concentrate | Before Last Replenishment | After Last Replenishment | % Removal of Coating in Cleaning |
| None | None | 7.6 | | 30 |
| 2.7 | None | 7.4 | | 5 |
| 2.7 | 12.5 | | 7.6 | 25 |

The results in Table 3.1 show that cleaning is relatively slow at this low alkalinity, but the process is functioning according to the invention and could be economically satisfactory if the cost of a long cleaning time is not prohibitive and replenishment is very frequent or preferably continuous.

In the second part of this group, the initial aqueous liquid cleaning composition contained 16.6% by volume of the make-up concentrate. Results are shown in Table 3.2 below.

TABLE 3.2

| Cumulated Additions, per Liter: | | Points of Free Alkalinity | | |
|---|---|---|---|---|
| Grams of Stearic Acid | ml of Replenisher Concentrate | Before Last Replenishment | After Last Replenishment | % Removal of Coating in Cleaning |
| None | None | 11.8 | | 90 |
| 2.7 | None | 11.8 | | 60 |
| 5.4 | None | 11.6 | | 70 |
| 5.4 | 12.5 | | 12.0 | 50 |
| 8.1 | 12.5 | 11.8 | | 40 |
| 8.1 | 27.5 | | 12.0 | 55 |
| 10.8 | 27.5 | 11.9 | | 80 |
| 10.8 | 57.5 | | Not measured | 80 |

The results in Table 3.2 indicate that the initially chosen replenishment amount was less than optimal, but the process is functioning according to the invention, albeit somewhat inefficiently. The alkalinity is higher than optimum, and this may result in more difficult management of the solution as it is used.

In the third part of this group, the initial aqueous liquid cleaning composition was a 13.6% by volume solution of the make-up concentrate. This, as shown in Table 3.3 below, produced better initial results than the initial aqueous liquid cleaning compositions with either lower or higher initial alkalinity that were prepared in the first and second parts of this group.

Results after further additions of stearic acid and replenisher are also shown in Table 3.3. These results further indicate that:

TABLE 3.3

| Cumulated Additions per Liter: | | Ratio, ml of Replenisher Concentrate: | Points of Free Alkalinity | | % |
|---|---|---|---|---|---|
| Grams of Stearic Acid | ml of Replenisher Concentrate | Grams of Stearic Acid | Before Last Replenishment | After Last Replenishment | Removal of Coating in Cleaning |
| None | None | 0 | 9.6 | | 100 |
| 2.7 | None | 0 | 9.6 | | 100 |

TABLE 3.3-continued

| Cumulated Additions per Liter: | | Ratio, ml of Replenisher Concentrate: | Points of Free Alkalinity | | % |
|---|---|---|---|---|---|
| Grams of Stearic Acid | ml of Replenisher Concentrate | Grams of Stearic Acid | Before Last Replenishment | After Last Replenishment | Removal of Coating in Cleaning |
| 5.4 | None | 0 | 9.4 | | 95 |
| 5.4 | 12.5 | 2.3 | | 9.7 | 70 |
| 8.1 | 12.5 | 1.5 | 9.4 | | 50 |
| 8.1 | 27.5 | 3.4 | | 9.6 | 75 |
| 10.8 | 27.5 | 2.5 | 9.4 | | 25 |
| 10.8 | 57.5 | 5.3 | | 9.5 | 75 |
| 13.5 | 57.5 | 4.3 | 9.5 | | 80 |
| 13.5 | 102 | 7.5 | | 9.9 | 98 |
| 16.2 | 102 | 6.3 | 9.8 | | 100 |
| 18.9 | 102 | 5.4 | 9.8 | | 90 |
| 21.6 | 102 | 4.7 | Not measured | | 85 |
| 24.3 | 102 | 4.2 | 9.5 | | 75 |
| 28.0 | 102 | 3.6 | 8.9 | | 70 |
| 28.0 | 142 | 5.07 | | 9.9 | 95 |
| 30.7 | 142 | 4.6 | 9.8 | | 85 |

The cleaning effectiveness after small additions of stearic acid is better maintained, even without replenishment, than is the cleaning effectiveness under similar conditions of the lower and higher alkalinity aqueous liquid cleaning compositions prepared for the first and second parts of this group.

With these particular materials:

The initially chosen rate of about 3 ml of replenisher concentrate per gram of stearic acid was too low to maintain constant cleaning effectiveness, but even after the cleaning effectiveness tell to only 25% of its initial value, it could be fully restored.

Constant high cleaning capacity could probably be maintained by sufficiently frequent additions of the replenisher corresponding to about 5 ml of replenisher concentrate per gram of stearic acid equivalent added.

There was a time lag between the addition of replenisher and its full effect in restoring cleaning power. (In these experiments, the aqueous liquid cleaning composition was kept agitated by a magnetic stirring bar. More vigorous agitation would probably improve the consistency of the cleaning effectiveness, if discrete rather than continuous additions of replenisher are used as they were in these examples.)

There is no evident reason to doubt that cleaning effectiveness of this aqueous liquid cleaning composition could be maintained for a considerably longer time by continued timely additions of replenisher.

The optimum alkalinity after replenishment is slightly higher than the alkalinity of the initially prepared aqueous liquid cleaning composition.

EXAMPLE AND COMPARISON EXAMPLE GROUP 4

In this group, the stability of candidate concentrate compositions according to the invention was evaluated under various conditions of storage. Details are given in Table 4 below.

TABLE 4

| Ingredient | 4.1 | 4.2 | 4.3 | 4.4 | 4.5 | 4.6 |
|---|---|---|---|---|---|---|
| | Percent by Mass of Ingredient in Concentrate Composition Number: | | | | | |
| Water | 65.6 | 64.0 | 62.0 | 47.2 | 60.6 | 60.6 |
| Sodium glucoheptonate, 50% in water | 6.2 | 6.2 | 6.2 | 6.2 | 6.2 | 6.2 |
| Sodium chloride | 4.6 | 4.6 | 4.6 | 4.6 | 4.6 | 4.6 |
| Sodium xylene sulfonate, 40% in water | none | none | none | none | 5.0 | none |
| TRITON ™ H-66 surfactant | none | none | none | none | none | 5.0 |
| MIRAPOL ™ WT polyquat solution | 2.0 | 2.0 | 2.0 | 2.0 | 2.0 | 2.0 |
| Potassium hydroxide, 45% in water | 7.2 | 7.2 | 7.2 | 40.0 | none | none |
| Sodium Hydroxide, 50% in water | 14.4 | 16.0 | 18.0 | none | 21.6 | 21.6 |
| Conditions of Storage | Homogeneous Liquid after Storage for Concentrate Composition Number: | | | | | |
| No storage; immediately after preparation | Yes | Yes | Yes | No | No | Yes |
| Stored at 4.4° C. for 5 days | Yes | Yes | No | Note 1 | Note 1 | No |
| Stored at 49° C. for 5 days | Yes | Yes | No | Note 1 | Note 1 | No |
| Freeze and Thaw, 5 cycles | Note 2 | Note 2 | No | Note 1 | Note 1 | No |

NOTES FOR TABLE 4

1. This measurement was not made, because the lack of homogeneity immediately after preparation means that the composition is not commercially satisfactory.

2. The composition was not homogeneous immediately after storage without mechanical agitation, but a single shake of the container restored its homogeneity. This behavior is considered commercially satisfactory, because the contents of any container of the concentrate that has been subjected to freezing and thawing can be readily restored to homogeneity by a short period of mechanical agitation.

The results in Table 4 indicate that compositions that include both potassium and sodium hydroxides are more storage stable than those that contain only one of these materials. Preferred concentrates such as 4.1 and 4.2 in Table 4, on the other hand, appear to be stable to most if not all practically encountered storage conditions.

EXAMPLE GROUP 5

This group illustrates the value of corrosion inhibitor in preventing flash rusting, which is acceptable for certain uses of the invention but not acceptable for others. A stock working aqueous liquid cleaning composition was prepared by dissolving Concentrate 4.2 in water to form a working composition with a free alkalinity of about 7.5 points. Specimens as described for Group 2 were cleaned with this working composition by immersion for 10 minutes while the temperature was maintained at 90–91° C. 80–85% of the coating was removed, but the cleaned surface showed golden-hued flash rust. In a second test, 5 g/l of sodium m-nitrobenzene sulfonate was added to the working composition and the cleaning test repeated with this modified aqueous liquid cleaning composition according to the invention. 90–95% removal of the coating was achieved in this test, and no flash rust was visible.

EXAMPLE 6

A suitable high alkalinity working composition according to the invention was prepared as follows. A first and a second concentrate were first made from the ingredients shown in Table 4 below. The balance to 100% not shown in Table 4 was water.

TABLE 4

| Ingredient | Percent of Ingredient in Concentrate Number: 4.1 | 4.2 |
|---|---|---|
| 50% NaOH in water | 91 | 4.9 |
| 45% KOH in water | none | 2.8 |
| 50% Sodium glucoheptonate in water | 9.0 | 2.1 |
| Sodium chloride | none | 21 |
| MIRAPOL ™ WT | none | 2.8 |

The Example 6 working composition was then made by mixing 70 g/l of Concentrate 4.1 and 60 g/l of Concentrate 4.2 with additional water to selected volume. This working composition has a Free Alkalinity Points value of 21 and is much faster in removing difficult coatings than working compositions with a Free Alkalinity Points value of 9–10 as used in Group 3. By varying the amounts of these two concentrates used, working compositions with any desired alkalinity between at least 9 and about 25 can be made to suit the degree of difficulty of cleaning involved.

What is claimed is:

1. A process for cleaning at least partially solid unwanted material that includes at least one of intermediate length carboxylic acids and salts thereof from a surface of an underlying solid substrate that is not damaged by contact with water, said process comprising contacting said unwanted material with a homogeneous aqueous liquid cleaning composition that interacts with said unwanted material to cause transfer of the unwanted material from the surface of said solid substrate to dispersion, solution, or both dispersion and solution in said aqueous liquid cleaning composition or to a solid phase physically separated from said solid substrate, wherein the improvement comprises utilizing in said process an aqueous liquid cleaning composition that causes at least the anions of said intermediate length carboxylic acids and salts thereof to segregate themselves into a distinct solid phase that floats on the surface of said aqueous liquid cleaning composition until removed therefrom, so that the used aqueous liquid cleaning composition has a Babcock Test Value that is not more than 0.075.

2. A liquid composition that is suitable for use, directly or after being diluted with water, as the homogeneous aqueous liquid cleaning composition in a process according to claim 1, said aqueous liquid cleaning composition comprising water and:

(A) a component of dissolved strongly dissociated cations and anions each with a molecular weight not more than 100 Daltons; and (B) a component of dissolved, dispersed, or both dissolved and dispersed cations with an average molecular weight of at least 200 Daltons, said aqueous liquid cleaning composition further having at least 5.0 points of free alkalinity.

3. A liquid composition according to claim 2, wherein the cations of component (B) contain at least two quaternary ammonium moieties each.

4. A liquid composition according to claim 3, wherein the cations of component (B) are cations of polymers selected from the group consisting of:

homopolymer molecules that are homopolymers of first monomer molecules that contain at least one tertiary amino moiety and at least one leaving group moiety in each first monomer molecule; and copolymer molecules that are copolymers of second monomer molecules and distinct third monomer molecules, each of said second and said third monomer molecules containing at least two moieties selected from the group consisting of tertiary amino moieties and leaving group moieties.

5. A liquid composition according to claim 4, wherein the cations of component (B) have a molecular weight, measured by intrinsic viscosity, that is from about $1\times10^3$ to about $10^7$.

6. A liquid composition according to claim 5, wherein at least 70% of the cations of component (B) contain both quaternary ammonium moieties and amido moieties.

7. A liquid composition according to claim 4, wherein at least 70% of the cations of component (B) contain both quaternary ammonium moieties and amido moieties.

8. A liquid composition according to claim 3, wherein at least 70% of the cations of component (B) contain both quaternary ammonium moieties and amido moieties.

9. A liquid composition according to claim 8, wherein component (B) includes numbers of nitrogen atoms and of carbon atoms such that the ratio of the number of nitrogen atoms to the number of carbon atoms is from about 0.05:1.00 to about 0.7:1.00.

10. A liquid composition according to claim 7, wherein component (B) includes numbers of nitrogen atoms and of carbon atoms such that the ratio of the number of nitrogen atoms to the number of carbon atoms is from about 0.05:1.00 to about 0.7:1.00.

11. A liquid composition according to claim 6, wherein component (B) includes numbers of nitrogen atoms and of carbon atoms such that the ratio of the number of nitrogen atoms to the number of carbon atoms is from about 0.05:1.00 to about 0.7:1.00.

12. A liquid composition according to claim 5, wherein component (B) includes numbers of nitrogen atoms and of carbon atoms such that the ratio of the number of nitrogen atoms to the number of carbon atoms is from about 0.05:1.00 to about 0.7:1.00.

13. A liquid composition according to claim 4, wherein component (B) includes numbers of nitrogen atoms and of carbon atoms such that the ratio of the number of nitrogen atoms to the number of carbon atoms is from about 0.05:1.00 to about 0.7:1.00.

14. A liquid composition according to claim 3, wherein component (B) includes numbers of nitrogen atoms and of carbon atoms such that the ratio of the number of nitrogen atoms to the number of carbon atoms is from about 0.05:1.00 to about 0.7:1.00.

15. A liquid composition according to claim 14, wherein there is a concentration of at least about 0.25 M/l of hydroxide.

16. A liquid composition according to claim 13, wherein there is a concentration of at least about 0.25 M/l of hydroxide.

17. A liquid composition according to claim 12, wherein there is a concentration of at least about 0.25 M/l of hydroxide.

18. A liquid composition according to claim 11, wherein there is a concentration of at least about 0.25 M/l of hydroxide.

19. A liquid composition according to claim 10, wherein there is a concentration of at least about 0.25 M/l of hydroxide.

20. A liquid composition according to claim 9, wherein there is a concentration of at least about 0.25 M/l of hydroxide.

21. A liquid composition according to claim 8, wherein there is a concentration of at least about 0.25 M/l of hydroxide.

22. A liquid composition according to claim 7, wherein there is a concentration of at least about 0.25 M/l of hydroxide.

23. A liquid composition according to claim 6, wherein there is a concentration of at least about 0.25 M/l of hydroxide.

24. A liquid composition according to claim 5, wherein there is a concentration of at least about 0.25 M/l of hydroxide.

25. A liquid composition according to claim 4, wherein there is a concentration of at least about 0.25 M/l of hydroxide.

26. A liquid composition according to claim 3, wherein there is a concentration of at least about 0.25 M/l of hydroxide.

27. A liquid composition according to claim 2, wherein there is a concentration of at least about 0.25 M/l of hydroxide.

28. A liquid composition according to claim 27, wherein there is additionally, as part of component (A), a concentration of neutral salt such that the ratio of the moles of neutral salt to the moles of hydroxide present in the liquid composition is at least about 0.12:1.00.

29. A liquid composition according to claim 26, wherein there is additionally, as part of component (A), a concentration of neutral salt such that the ratio of the moles of neutral salt to the moles of hydroxide present in the liquid composition is at least about 0.12:1.00.

30. A liquid composition according to claim 25, wherein there is additionally, as part of component (A), a concentration of neutral salt such that the ratio of the moles of neutral salt to the moles of hydroxide present in the liquid composition is at least about 0.12:1.00.

31. A liquid composition according to claim 24, wherein there is additionally, as part of component (A), a concentration of neutral salt such that the ratio of the moles of neutral salt to the moles of hydroxide present in the liquid composition is at least about 0.12:1.00.

32. A liquid composition according to claim 23, wherein there is additionally, as part of component (A), a concentration of neutral salt such that the ratio of the moles of neutral salt to the moles of hydroxide present in the liquid composition is at least about 0.12:1.00.

33. A liquid composition according to claim 22, wherein there is additionally, as part of component (A), a concentration of neutral salt such that the ratio of the moles of neutral salt to the moles of hydroxide present in the liquid composition is at least about 0.12:1.00.

34. A liquid composition according to claim 21, wherein there is additionally, as part of component (A), a concentration of neutral salt such that the ratio of the moles of neutral salt to the moles of hydroxide present in the liquid composition is at least about 0.12:1.00.

35. A liquid composition according to claim 20, wherein there is additionally, as part of component (A), a concentration of neutral salt such that the ratio of the moles of neutral salt to the moles of hydroxide present in the liquid composition is at least about 0.12:1.00.

36. A liquid composition according to claim 19, wherein there is additionally, as part of component (A), a concentration of neutral salt such that the ratio of the moles of neutral salt to the moles of hydroxide present in the liquid composition is at least about 0.12:1.00.

37. A liquid composition according to claim 18, wherein there is additionally, as part of component (A), a concentration of neutral salt such that the ratio of the moles of neutral salt to the moles of hydroxide present in the liquid composition is at least about 0.12:1.00.

38. A liquid composition according to claim 17, wherein there is additionally, as part of component (A), a concentration of neutral salt such that the ratio of the moles of neutral salt to the moles of hydroxide present in the liquid composition is at least about 0.12:1.00.

39. A liquid composition according to claim 16, wherein there is additionally, as part of component (A), a concentration of neutral salt such that the ratio of the moles of neutral salt to the moles of hydroxide present in the liquid composition is at least about 0.12:1.00.

40. A liquid composition according to claim 15, wherein there is additionally, as part of component (A), a concentration of neutral salt such that the ratio of the moles of neutral salt to the moles of hydroxide present in the liquid composition is at least about 0.12:1.00.

41. A liquid composition according to claim 2 additionally comprising at least one of the following components:

at least about 0.006 M/l of sequestering agent; and at least about 2.0 g/l of sodium meta-nitrobenzene sulfonate.

42. A liquid single package make-up concentrate composition which when diluted with water forms a liquid composition according to claim 2, said make-up concentrate composition comprising:

at least about 1.2 M/kg of hydroxide;

at least about 5 ppt of component (B); and at least about 0.04 M/kg of component (C).

43. A liquid replenisher composition for use in a process according to claim 1, wherein:

the composition comprises both sodium and potassium hydroxides and has a molar ratio of potassium to sodium hydroxide that is from 0.20:1.00 to 0.40:1.00;

the composition comprises at least one strongly dissociated neutral salt in which all anions and cations in the neutral salt have a molecular weight of not more than 100 Daltons, and the molar ratio of neutral salt to hydroxide is from about 2.0:1.00 to about 6.0:1.00;

the composition comprises polymeric cations that:

have a molecular weight, as measured by intrinsic viscosity, that is at least $1\times10^3$; and contain at least two quaternary ammonium moieties each, and all of said polymeric cations together in the composition:

contain numbers of nitrogen atoms and carbon atoms such that the ratio of the number of nitrogen atoms to the number of carbon atoms is from about 0.20:1.00 to about 0.40:1.00; and have a mass in grams that has a ratio to the number of moles of hydroxide in the replenisher composition that is from about 22:1.00 to about 50:1.00; and the composition comprises a number of moles of sequestering agent, and said number of moles has a ratio to the number of moles of hydroxide in the replenisher composition that is from about 0.024:1.00 to about 0.080:1.00.

* * * * *